United States Patent [19]

Yoshida

[11] Patent Number: 4,482,100

[45] Date of Patent: Nov. 13, 1984

[54] BEAM WINDING APPARATUS

[75] Inventor: Yorikazu Yoshida, Kurobe, Japan

[73] Assignee: Yoshida Kogyo K.K., Tokyo, Japan

[21] Appl. No.: 576,943

[22] Filed: Feb. 3, 1984

Related U.S. Application Data

[63] Continuation-in-part of Ser. No. 302,730, Sep. 16, 1981, abandoned.

[30] Foreign Application Priority Data

Sep. 27, 1980 [JP] Japan ..... 55-133695

[51] Int. Cl.[3] ..... B65H 75/00; B65H 54/28

[52] U.S. Cl. ..... 242/55; 242/16; 242/25 R; 242/67.1 R; 242/158 R; 242/158.4 R; 242/DIG. 2; 242/118.1; 242/118.7

[58] Field of Search ..... 242/158 R, 158.2, 158 F, 242/158.4 R, 158.4 A, DIG. 2, 16, 17, 18 R, 25 R, 118.1, 118.4, 118.7, 118.8, 67.1 R, 1, 55

[56] References Cited

U.S. PATENT DOCUMENTS 3,498,567 3/1970 Baker et al. ..... 242/158.4 R 3,963,186 6/1976 Van den Aa ..... 242/158 R X

FOREIGN PATENT DOCUMENTS 679859 8/1939 Fed. Rep. of Germany ... 242/118.1

*Primary Examiner*—Stanley N. Gilreath

*Attorney, Agent, or Firm*—Bucknam & Archer

[57] ABSTRACT

A beam winding apparatus for helically winding elongate strips of textile material on a beam for treatment with a treatment liquid. The beam is in the form of a rotatable perforated cylindrical tube having a central barrel portion, a pair of flanges at opposite ends of the tube, and a pair of conical portions each disposed between the central barrel portion and a respective one of the flanges. The apparatus also comprises means for transversing the strips of textile material between the opposite ends of the perforated tube, the traversing means including a pivotally supported guide member slidably movable over the layers of strips that have been wound on the tube, and means for switching the directions of winding the strips upon arrival of the guide member at the conical portions.

6 Claims, 8 Drawing Figures

BEAM WINDING APPARATUS

This is a continuation-in-part of application Ser. No. 302,730 filed Sept. 16, 1981, now abandoned.

BACKGROUND OF THE INVENTION

1. Field of the Invention

This invention relates to apparatus for winding textile materials on a cylindrical tube. More specifically, the invention pertains to apparatus for winding relatively narrow strips of fabric such as slide fastener stringer tapes on a socalled "beam" for treatment with dyeing, bleaching and other liquid media.

2. Prior Art

There are known a variety of beam devices, a typical example of which includes a perforated cylindrical tube or beam with both ends closed by disc flanges extending substantially at right angles to the axis of the tube. When wrapping the beam with an elongate strip of fabric tape, this is done by winding the strip helically from one end to the other and inverting the direction of feed of the same upon arrival at either of the opposed flanges of the beam, with the results that the layers of strip become less dense at the areas adjoining the flanges than at the remaining peripheral areas of the beam and hence are disposed less stably. As a treatment liquid is forced through the layers of strip or tape in such a condition, the flow of the liquid tends to be directed predominantly toward the less dense layer material at the flange areas, resulting in locally overtreated material or otherwise defective finish of the material. This difficulty, in the case of continuous slide fastener tapes carrying rows of coupling elements, would give rise to deformation of the tape web under the influence of liquid pressure. This tendency is greater the more volume of the wound material, imposing a control on the amount of material that can be wound on a beam of a given size. Further, it has been a common practice to utilize a pair of limit switches and a lever mechanism, both mounted on the beam, to switch the direction of helical winding of the strip.

An improved beam, which has been proposed by a commonly assigned copending U.S. patent application Ser. No. 302,731 filed Sept. 16, 1981, has a pair of perforated conical portions each disposed between a central barrel portion and a respective one of a pair of flanges at opposite ends of the beam. However, the limit-switch-and-lever control cannot be adaptable for use with the improved beam. The invention is an improvement over the prior art control.

SUMMARY OF THE INVENTION

It is accordingly an object of the invention to provide an apparatus for helically winding elongate strips of textile material uniformly and properly over a beam for treatment with a treatment liquid.

Another object of the invention is to provide an apparatus for helically winding the strips textile material, which apparatus has a simple construction and hence is inexpensive.

Above and other objects and features of the invention will be more apparent from reading the following description taken in connection with the accompanying drawings which illustrate by way of example a preferred embodiment.

According to the invention, there is provided a beam winding apparatus for helically winding elongate strips of material which comprises a rotative perforated cylindrical tube having a central barrel portion, and a pair of flanges at opposite ends of the tube and a conical portion disposed between the central barrel portion and each of the flanges, means of traversing the strips of material between the opposite ends of said perforated tube, the traversing means including a pivotally supported guide member slidably movable over the layers of strips that have been wound on the tube, and means of switching the directions of winding the strips upon arrival of the guide member at the conical portion.

BRIEF DESCRIPTION OF THE ACCOMPANYING DRAWINGS

DETAILED DESCRIPTION OF THE PREFERRED EMBODIMENT

Figure 1:
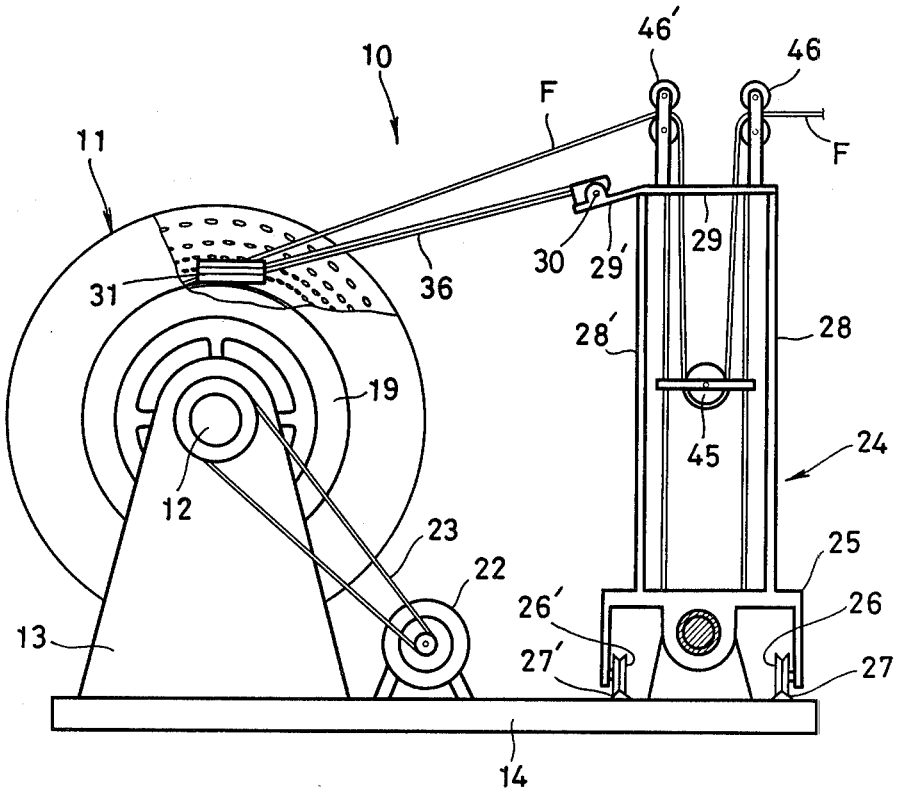
FIG. 1 is a slide elevation of a beam winding apparatus embodying the invention.

Referring now to the drawings and FIG. 1 in particular, there is shown a beam winding apparatus 10 for helically winding relatively narrow, elongate strips of textile material into a cylindrical form for treatment with dyeing, bleaching or other liquid media. The apparatus 10 includes a perforated cylindrical tube 11 commonly known as a "beam" which is mounted in horizontal disposition rotatably on a drive shaft 12 extending between a pair of collars 13 secured to a base 14.

Figure 3:
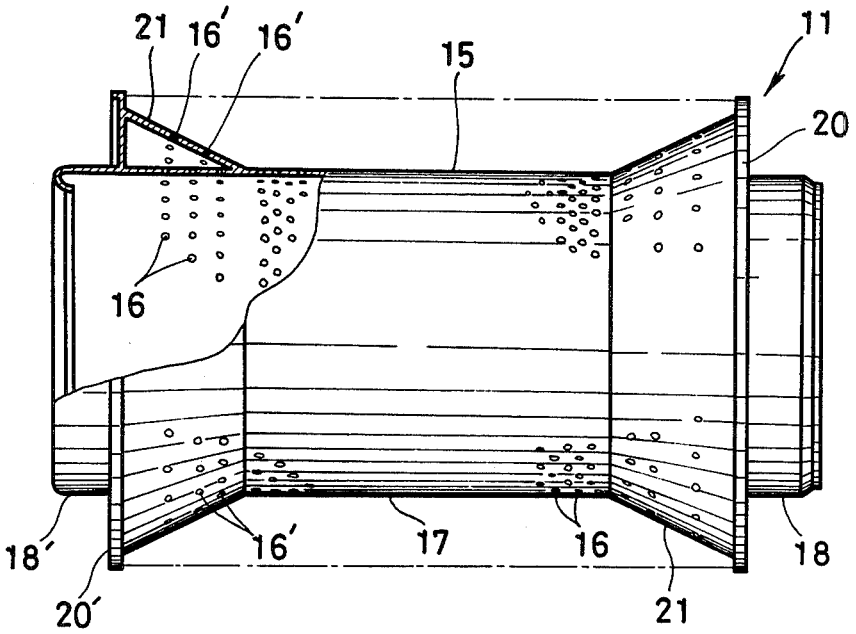
FIG. 3 is a plan view, partly broken away, of a beam provided in accordance with the invention.
Figure 4:
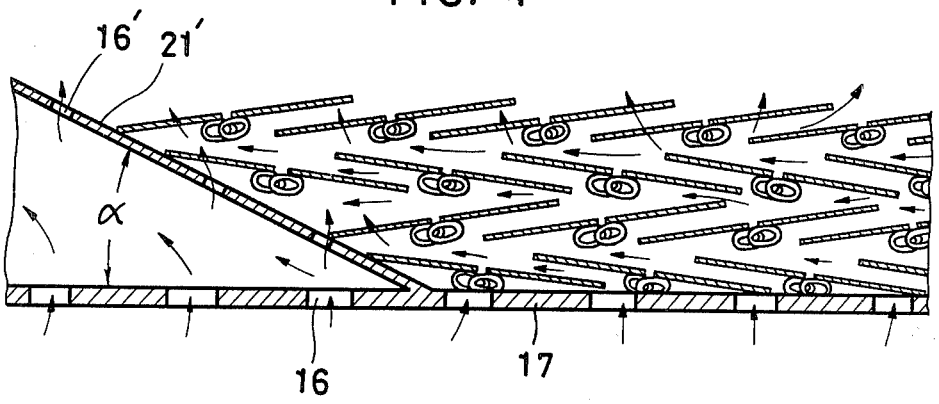
FIG. 4 is a longitudinal cross-sectional view of a part of the beam of FIG. 3, schematically illustrating slide fastener stringers wound on the beam.

The beam 11, as better shown in FIG. 3, comprises a cylindrical tube 15 provided with a multiplicity of perforations 16 through which a liquid medium such as a dye is allowed to pass radially outward from inside the tube 15 and penetrate the layers of material wound thereon, the material here being shown for illustrative purposes to be slide fastener stringers F carrying rows of coupling elements E.

The tube 15 has a central barrel portion 17 of uniform diameter and an extension 18,18' thereof at each of its ends engageable peripherally with a disc-like support 19 (FIG. 1) secured to the shaft 12. The disc-like support 19 is secured to the shaft 12 for co-rotation therewith, and snugly engages on its periphery with the inner periphery of one of the hollow extensions 18, 18' of the tube 15 so that such tube 15 and supports 19 are co-rotatable upon rotation of the shaft 12. A pair of disc flanges 20,20' are provided adjacent the respective end extensions 18,18' and extend a predetermined distance above the barrel portion 17.

The tube 15 further includes a pair of conical portions 21,21' which flare radially outward from the barrel portion 17 towards and are connected to the respective flanges 20,20'. The conical portions 21,21' are also provided with perforations 16' communicating with the interior of the tube 15, but these perforations should be adjusted in their number or in their size so as to reduce the amount of liquid flow per unit area commensurate with the thickness of the layers of material which diminishes progressively toward the flanges 20,20', so that the material at the conical portions 21,21' can be dyed or otherwise treated uniformly and substantially to the same extent as the portion of the material that is wound on the barrel 17 of the beam 11.

In the illustrated embodiment, the perforations 16' at each of the conical portions 21,21' are substantially equal in size to the perforation 16 at the barrel portion 17, but the pore-to-pore spacing of the perforations 16' increases proportionately with an increase in the diameter of the conical portion 21,(21').

It has now been found that the angle of inclination $\alpha$ of the generatrix of the conical portion 21,(21') with respect to the axis of the tube 15 is preferably of the order of $25° \pm 5°$ to obtain best results with treatment of ordinary slide fastener stringers having a fabric tape about 5–20 mm wide and a row of coupling elements about 3 to 4 times thicker than the tape. Departures from this angle range would result in off-specification products.

In the case of flat tapes, the above angle may be much greater but should not exceed 70°. If it is below 15°, then the results would be no more different than would be with a flangeless tubular beam.

Figure 5:
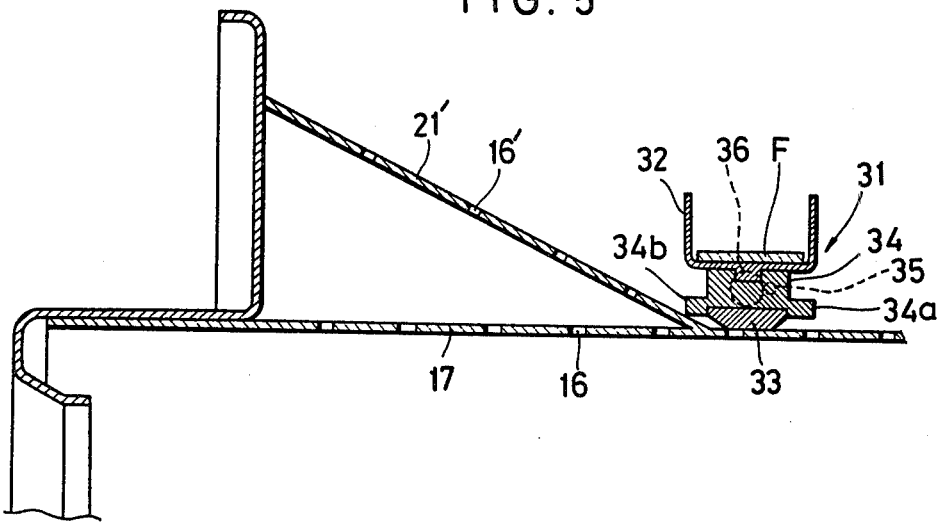
FIG. 5 is a schematic sectional view of a part of the apparatus of FIG. 1, illustrating one form of a fastener chain guide.

Turning back to FIG. 1, the beam 11 is rotably mounted on the shaft 12 which is driven by motor 22 via drive belt 23. A chain of slide fastener stringers designated at F is supplied from a source not shown and wound helically on the beam 11 as the latter rotates. Feed of the fastener chain F is traversed or shifted between the opposite ends of the beam 11 by a feed traversing or shifting mechanism generally designated at 24. This mechanism includes a rack 25 attached with a pair of rollers 26,26' movably mounted on respective rails 27,27' secured to the base 14. A pair of vertical pillars 28,28' extend from the rack 25 and are joined at their upper ends by a horizontal bar member 29. This member has an extension 29' provided with a support pin 30. A fastener chain guide 31 comprises, as better shown in FIG. 5, a U-shaped guide frame 32 for receiving the wound chain F during feed thereof, a slide member 33 made of an electrically insulative, plastic material disposed for sliding engagement with the fastener chain F and a metallic box member 34 interposed between guide frame 32 and slide member 33 and having connected thereto an electrical wire 35 for purposes to be hereafter described, the members 32,33 and 34 being integrally formed. The chain guide 31 is connected to an arm 36 which is in turn connected pivotally to the support pin 30.

The rack 25 is threadedly engaged with a screw shaft 37 extending parallel with the rails 27,27' and journalled in oppositely disposed bearings 38,38'. The screw shaft 37 is provided at one end thereof with a pair of bevel gears 39,39' which are alternately connected and disconnected to a gear 40 on a drive shaft 41 of a motor 42 by means of respective electromagnetic clutches 43,43', the arrangement being that energizing one of the clutches 43,43' causes the screw shaft 37 to rotate and hence the rack 25 to move in one direction and energizing the other clutch reverses rotation of the screw shaft 37 and hence moves the rack 25 in the opposite direction, whereby the chain guide 31 follows such movement of the rack 25. Selective energization of the clutches 43,43' is effected by a relay circuit (FIG. 8) to which the electrical wire 35 is connected.

Figure 8:
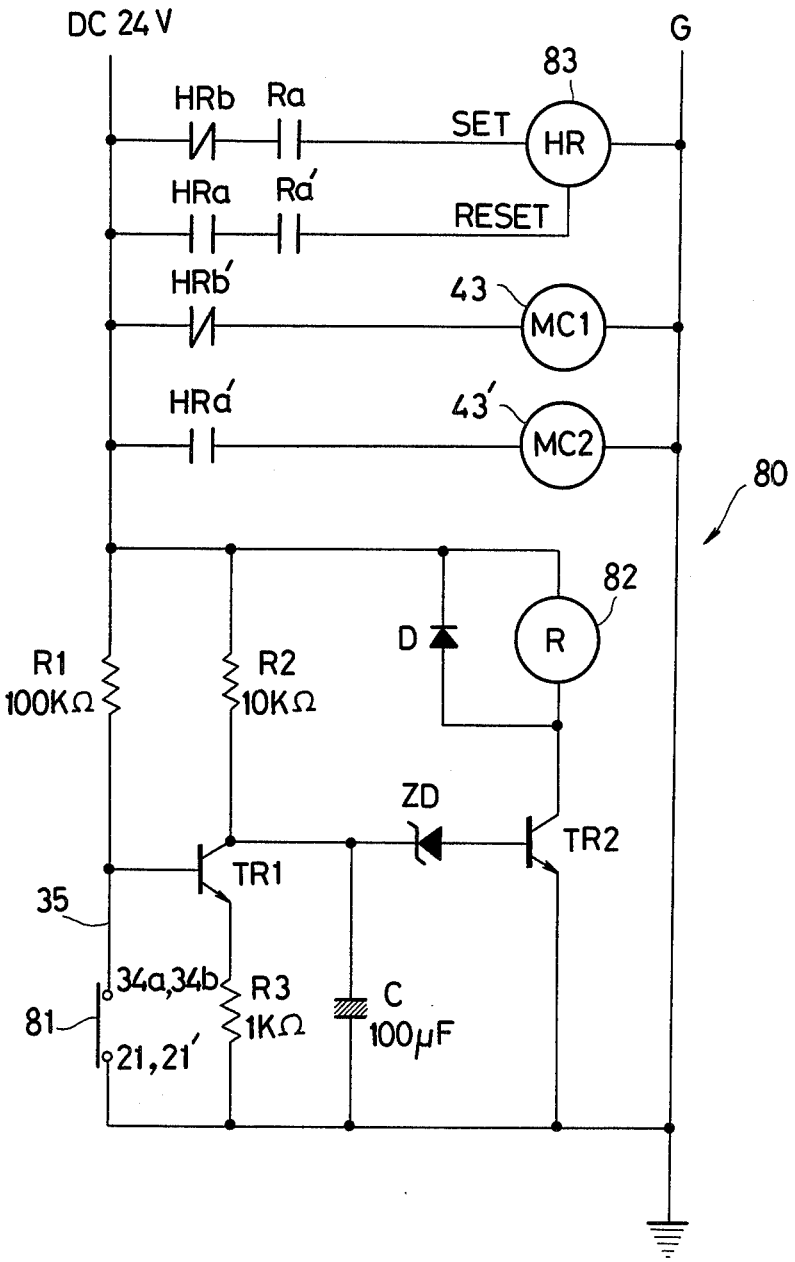
FIG. 8 is a circuit diagram of a relay circuit for controlling operation of the apparatus.

The metallic box member 34 of the chain guide 31 has on its opposite sides projections **34*a*,34*b* which extend horizontally in registry with or slightly beyond respective sides of the U-shaped guide frame 32 so that the projections 34*a*,34*b* can come into contact with the conical portions 21,21' of the beam 11. As shown in FIG. 8, the relay circuit 80 includes a switch 81 constituted by the projections 34*a*, 34*b* and the mating conical portions 21, 21' of the metallic beam 11, and a relay 82 connected through the electric wire 35 to both projections 34*a*, 34*b*. The relay 82 is also connected to the ground G to which the conical portions 21, 21' are connected. Thus the relay 82 is energized to close its normally-open contacts Ra, Ra' each time the switch 81 is turned on upon engagement of one of the projections 34*a*, 34*b* with a corresponding one of the conical portions 21, 21'. The realy circuit 80 further includes a holding relay 83 connected to the contacts Ra, Ra' of the relay 82 so as to be activated by the latter when the contacts Ra, Ra' are closed. The holding relay 83 has a pair of normally-open contacts HRa, HRa', and a pair of normally-closed contacts HRb, HRb'. One of the normally-open contacts HRa' is connected to the electromagnetic clutch 43' to activate the same when it is closed. Likewise, one of the normally-closed contacts HRb' is connected to the electromagnetic clutch 43 to de-energize the same when it is open. The holding relay 83** is set when the contacts HRb and Ha are closed, and is reset when the contacts HRa and Ra' are closed.

Figure 2:
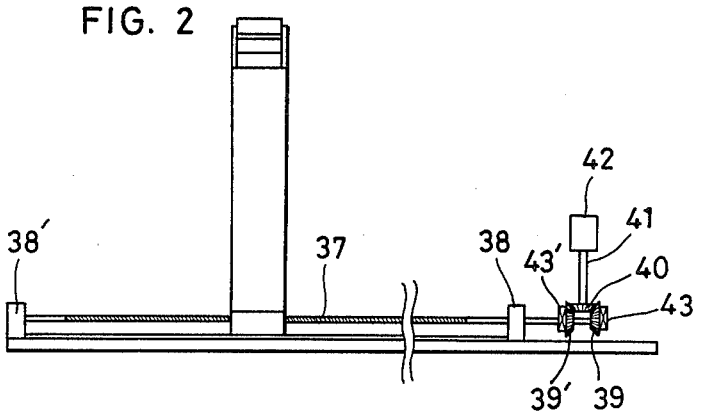
FIG. 2 is a plan view of a part of the apparatus shown in FIG. 1.

Operation of the apparatus 10 is described as follows. For purposes of illustration, the operation begins with the apparatus 10 as in the position of FIGS. 1 and 2 in which the chain guide 31 is located at an intermediate position of the screw shaft 37 and the projections **34*a*, 34*b* are held out of contact with the conical portions 21, 21'. Since the switch 81 is open, the relay 82 is de-energized and the holding relay 83 is reset, so that the clutch 43 is energized. When the motor 42 is energized, the chain guide 31 is moved in a first direction (righthand in FIG. 2) on the shaft 37 through the gears 39, 40. Continuous movement of the chain guide 31 causes the projection 34*a* to engage with the conical portion 21 whereupon the switch 81 is activated to close its normally-open contacts Ra, Ra'. With the contact HRb, Ra closed, the holding relay 83 is set to close the contacts HRa, HRa', energizing the clutch 43' whereby the chain guide 31 is moved in a second or reversed direction (lefthand in FIG. 2). The relay 82 is de-activated upon separation of the projection 34*a* from the contical portion 21 to open the switch 81, however, the clutch 43 is kept energized by means of the holding relay 83. On contact with the projection 34*b* with the conical portion 21', the switch 81 is closed again to activate the relay 82. With the contact HRa, Ra' closed, the holding relay 83 is reset, thereby energizing the clutch 43. Thus, the chain guide 31 is fed again the first direction (righthand in FIG. 2**).

Figure 6:
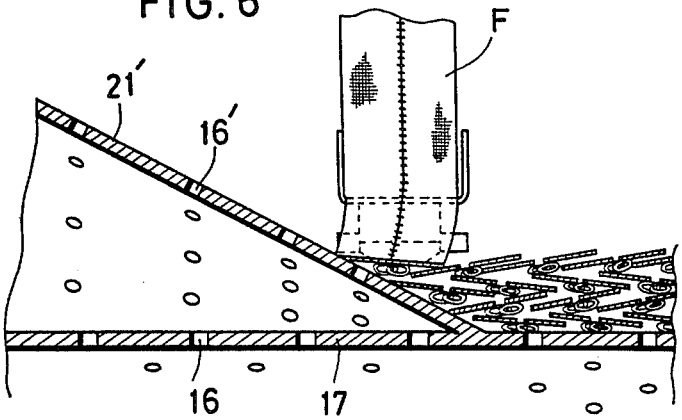
FIG. 6 is a schematic sectional view illustrating the process of winding slide fastener stringers.

This reciprocal shifting or traversing operation of the mechanism 24 is repeated until the fastener chain F is wound substantially up to the brims of the flanges 20,20' as indicated by chain-dot lines in FIG. 3, in which instance the slide member 33 serves to facilitate smooth movement of the chain guide 31 of the traversing mechanism 24 over the layers of the fastener chain F that have been previously wound on the beam 11. The speed of winding and the speed of traversing are relatively adjusted so that the fastener chain F is helically wound with its adjacent tape portions partially overlapped as shown in FIG. 6.

Figure 7:
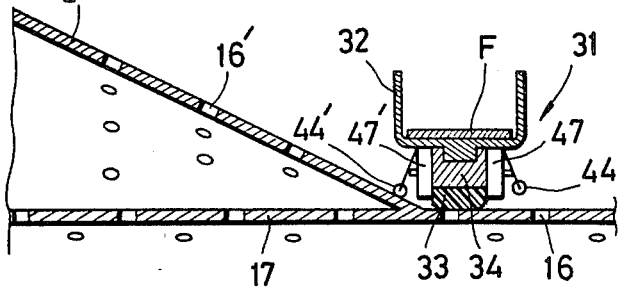
FIG. 7 is a schematic sectional view of a modified form of fastener chain guide.

There is shown in FIG. 7 a modified form of fastener chain guide 31 wherein a pair of spring-actuated ball members 44,44' are substituted for the projections 34*a*,34*b* and disposed for resilient contact with the conical surfaces of the beam 11. Each of the ball members 44,44', when brought in contact with a respective one of the opposite conical surfaces (21,21') of the beam 11, is pivotally moved to actuate a respective one of a pair of microswitches 47,47' which controls a relay circuit (not shown) to reverse the rotation of the screw shaft 37 (FIG. 2), thereby changing the direction of helical winding of the slide fastener chain F towards the other conical surface (21',21) of the beam 11.

Designated at 45 is a tension roller disposed for vertical movement in the known manner to maintain smooth feed movement of the fastener chain F passed between a pair of guide rollers 46,46' located above the tension roller 45.

Although various minor modifications may be suggested by those versed in the art, it should be understood that I wish to embody the scope of the patent warranted hereon, all such embodiments as reasonably and properly come within the scope of my contribution to the art.

What is claimed is:

1. A beam winding apparatus for helically winding an elongate strip of material, comprising:

(a) a rotative perforated cylindrical tube of metal and having a central barrel portion, a pair of flanges disposed at opposite ends of said tube and a conical portion disposed between said central barrel portion and each of said flanges, and (b) means for traversing the strip of material in opposite directions between the opposite ends of said perforated metallic tube, said traversing means including (1) a pivotally supported guide member slidably movable over the layers of strip that have been wound on said tube, said guide member including a frame portion receiving the strip of material, an electrically insulative plastic portion slidingly engageable with the layers of strip, and a metallic portion sandwiched between said frame and plastic portions in vertical alignment therewith and having a width substantially the same as the width of the strip, said metallic portion including opposite sections engageable with said conical portions of said metallic tube to define therewith an electrical switch, and (2) electric-power-driven actuation means electrically connected with said guide member and responsive to said electrical switch for actuating reversal of the traversing direction of winding the strip upon engagement of each of said opposite sections of said metallic portion with a corresponding one of said conical portions of said metallic tube.

2. A beam winding apparatus according to claim 1 wherein the conical portions of the tube are flared at an angle or inclination of the order of $25° \pm 5°$ with respect to the axis of said tube.

3. A beam winding apparatus according to claim 1 wherein the conical portions of the tube are provided with perforations adjusted in their pore number or their pore size to be commensurate with the thickness of the layers of strips to be wound.

4. A beam winding apparatus according to claim 3, wherein said perforations have a pore-to-pore spacing increasing proportionately with an increase in the diameter of the conical portions.

5. A beam winding apparatus according to claim 3 wherein said traversing means is threadedly engaged with and driven by a screw shaft.

6. A beam winding apparatus according to claim 1 wherein said strip of material is a slide fastener stringer chain.

* * * * *